United States Patent [19]

Sparkes

[11] Patent Number: 4,875,320

[45] Date of Patent: Oct. 24, 1989

[54] ROOF INSULATION SUPPORT SYSTEM

[76] Inventor: Julian G. Sparkes, P.O. Box 1293, Lebanon, Tenn. 37087

[21] Appl. No.: 199,017

[22] Filed: May 26, 1988

[51] Int. Cl.[4] ..... E04B 1/74

[52] U.S. Cl. ..... 52/406; 52/489; 52/484; 52/404

[58] Field of Search ..... 52/463, 404, 478, 484, 52/489, 406, 407

[56] References Cited

U.S. PATENT DOCUMENTS

| | | | |
|---|---|---|---|
| 2,866,527 | 12/1958 | Schilling | 52/463 |
| 3,828,508 | 8/1974 | Moeller | 52/489 |
| 3,849,956 | 11/1974 | Collins | 52/463 |
| 3,969,863 | 7/1976 | Alderman . | |
| 4,047,345 | 9/1977 | Alderman . | |
| 4,047,346 | 9/1977 | Alderman . | |
| 4,075,806 | 2/1978 | Alderman . | |
| 4,075,807 | 2/1978 | Alderman . | |
| 4,117,641 | 10/1978 | Wells | 52/404 |
| 4,147,003 | 4/1979 | Alderman | 52/407 |
| 4,172,345 | 10/1979 | Alderman | 52/407 |
| 4,375,742 | 3/1983 | Paliwoda | 52/463 |
| 4,384,437 | 5/1983 | Coles | 52/484 |
| 4,434,601 | 3/1984 | Zellmer . | |
| 4,452,021 | 6/1984 | Anderson | 52/484 |
| 4,566,239 | 1/1986 | Smigel et al. . | |
| 4,573,298 | 3/1986 | Harkins . | |
| 4,722,161 | 2/1988 | Young | 52/484 |
| 4,747,246 | 5/1988 | Sanborn | 52/484 |

*Primary Examiner*—Carl D. Friedman
*Assistant Examiner*—Caroline D. Dennison
*Attorney, Agent, or Firm*—Harrington A. Lackey

[57] ABSTRACT

An insulated roof support system including a plurality of transversely spaced longitudinally extending purlins having bottom flanges with insulation layers occupying the spaces between the purlins, a lattice work of transverse and longitudinal support straps extending beneath the insulation layers so that the transverse support straps extend beneath the bottom flanges of the purlins, a plurality of elongated channel-shaped support bars containing elongated insulation boards secured in flush engagement co-extensively against the bottom surface of each purlin bottom flange and the transverse straps crossing the purlins, to completely thermally insulate the roof structure including the purlins from the space below the roof structure.

6 Claims, 2 Drawing Sheets

ROOF INSULATION SUPPORT SYSTEM

BACKGROUND OF THE INVENTION

This invention relates to insulated roof support structure, and more particularly to an insulated support bar for the bottom of each purlin.

In the fabrication of a metal building including a metal sheet roof supported upon elongated parallel purlins mounted on transverse rafters, the roof has been insulated by various methods of installing loose insulation or layers of insulation material within the spaces between the purlins and below the sheet metal roof. Most of the methods for supporting the insulation material within each purlin cavity, that is the space between adjacent purlins, has been rather complex and expensive. Moreover, the labor for installing such insulation systems has also been expensive.

Various types of roof insulation support systems are disclosed in the following U.S. patents:

| | | |
|---|---|---|
| 3,969,863 | Alderman | Jul. 20, 1976 |
| 4,047,345 | Alderman | Sep. 13, 1977 |
| 4,047,346 | Alderman | Sep. 13, 1977 |
| 4,075,806 | Alderman | Feb. 28, 1978 |
| 4,075,807 | Alderman | Feb. 28, 1978 |
| 4,147,003 | Alderman | Apr. 3, 1979 |
| 4,172,345 | Alderman | Oct. 30, 1979 |
| 4,375,742 | Paliwoda | Mar. 8, 1983 |
| 4,384,437 | Coles | May 24, 1983 |
| 4,434,601 | Zellmer | Mar. 6, 1984 |
| 4,566,239 | Smigel et al | Jan. 28, 1986 |
| 4,573,298 | Harkins | Mar. 4, 1986 |

All of the above Alderman patents and the Harkins U.S. Pat. No. 4,573,298 disclose insulated roof structures incorporating a lattice-work of longitudinal and/or cross straps or transverse straps for supporting insulating material.

Alderman U.S. Pat. Nos. 3,969,863, Alderman 4,047,345, Alderman 4,047,346, Alderman 4,075,806, Alderman 4,147,003 (Insulating strip 14), Zellmer, Smigel, and Harkins (Col. 7, lines 23–26) disclose elongated insulated strips secured upon the top flange of each purlin.

Alderman U.S. Pat. Nos. 4,147,003 (FIGS. 3 and 4), Paliwoda (FIG. 3A), Coles, and Harkins (Col. 7, lines 23–26) disclose the use of elongated insulated strips fitted longitudinally upon the bottom surface of the bottom flange of each purlin.

However, none of the above patents disclose a roof insulation system in which an elongated insulated support bar is secured against the bottom flange of a purlin, trapping the cross straps between the support bar and the purlin, in order to completely insulate the purlin by means of a single fastener member for each transverse support strap and purlin.

SUMMARY OF THE INVENTION

It is therefore an object of this invention to provide a roof insulation support system utilizing elongated parallel purlins in which insulation material is supported by a lattice-work of support straps in which the metal roof and the purlins are completely insulated from the interior space of the building.

The insulated support bar made in accordance with this invention completely covers the bottom flange of each purlin, which in most previous roof support systems had been exposed to the interior space, as well as supports the transverse or cross support straps holding the remainder of the insulation in the purlin cavities in place.

Specifically, the insulated support bar is made of any desirable length, but of a width substantially co-extensive with the width of the bottom flange of each purlin. Each support bar is preferably channel-shaped to receive an insulated board and fit snugly against, and co-extensively with, the bottom flange of the purlin. Moreover, the insulated support bar traps and holds the cross or transverse support straps between the support bar and the bottom flange of the corresponding purlin.

In a preferred embodiment of the invention, each channel-shaped insulated support bar is provided with upstanding opposed side walls, which are formed with transversely aligned, longitudinally spaced notches for receiving the transverse straps through the notches, above the insulation bar, and beneath and against the bottom flange of each purlin.

Another object of this invention is to provide a rapid and inexpensive method of assembling insulated support bars and transverse support straps to the bottom flanges of the purlins in order, not only to completely insulate the purlins, but also to support the insulation between the purlins.

Only a single fastener is required to secure each transverse strap to a purlin. Moreover, this same single fastener also secures each insulated support bar to a corresponding bottom flange of a purlin for each location of a transverse strap.

DESCRIPTION OF THE PREFERRED EMBODIMENTS

Figure 1:
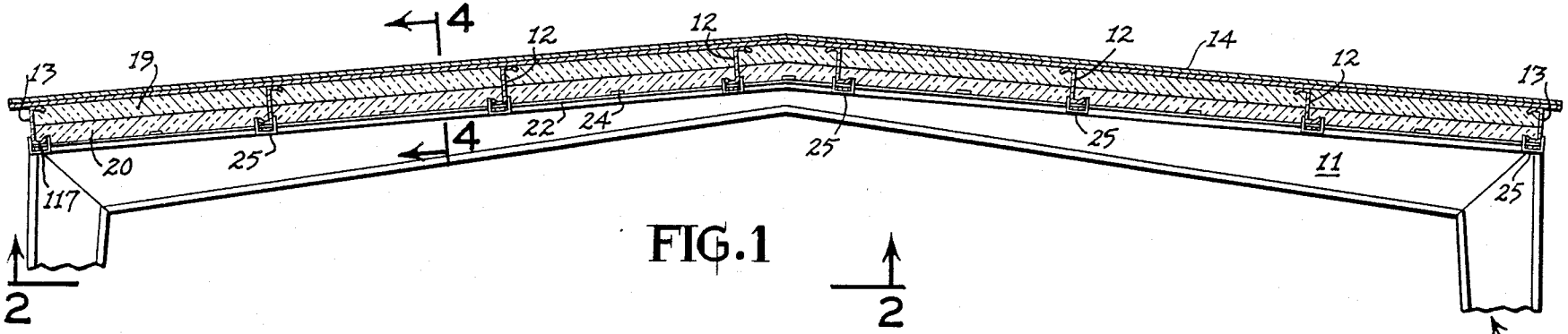
FIG. 1 is a fragmentary transverse sectional elevation of an insulated roof support structure made in accordance with this invention.

Referring now to the drawings in more detail, FIG. 1 discloses the upper portion of a metal building 10 incorporating the roof insulation support system made in accordance with this invention. As illustrated in FIG. 1, the building 10 includes a plurality of longitudinally spaced, transverse rafters 11, one of which is shown in FIG. 1, supporting a plurality of transversely spaced, elongated purlins 12, specifically Z-purlins, and eave struts 13 supporting a metal roof 14.

Figure 3:
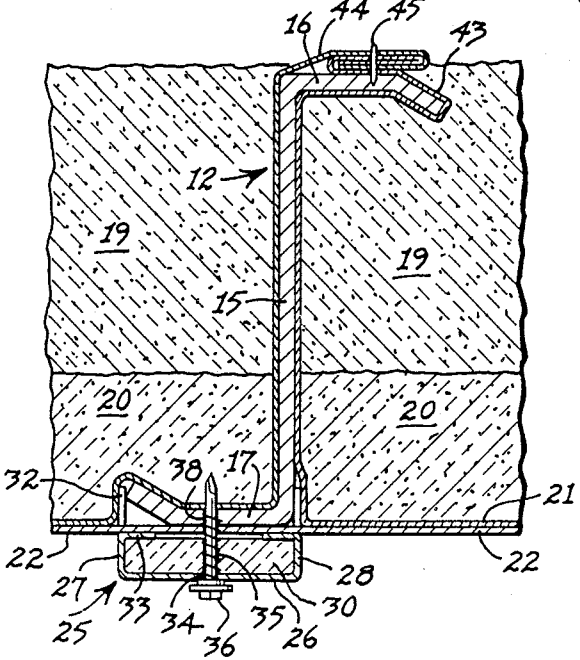
FIG. 3 is a greatly enlarged fragmentary section taken along the line 3—3 of FIG. 2, without the metal roof.
Figure 4:
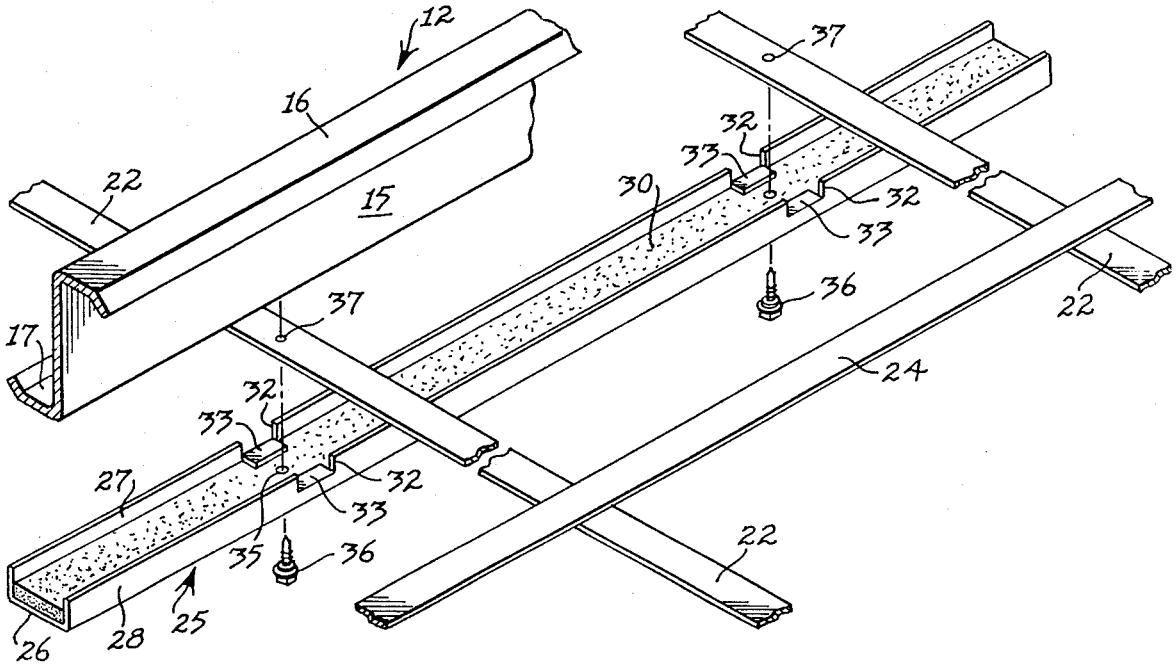
FIG. 4 is a fragmentary, exploded, perspective view of the insulated support bar made in accordance with this invention, and its associated elements in the process of assembly, taken along the line 4—4 of FIG. 1.
Figure 5:
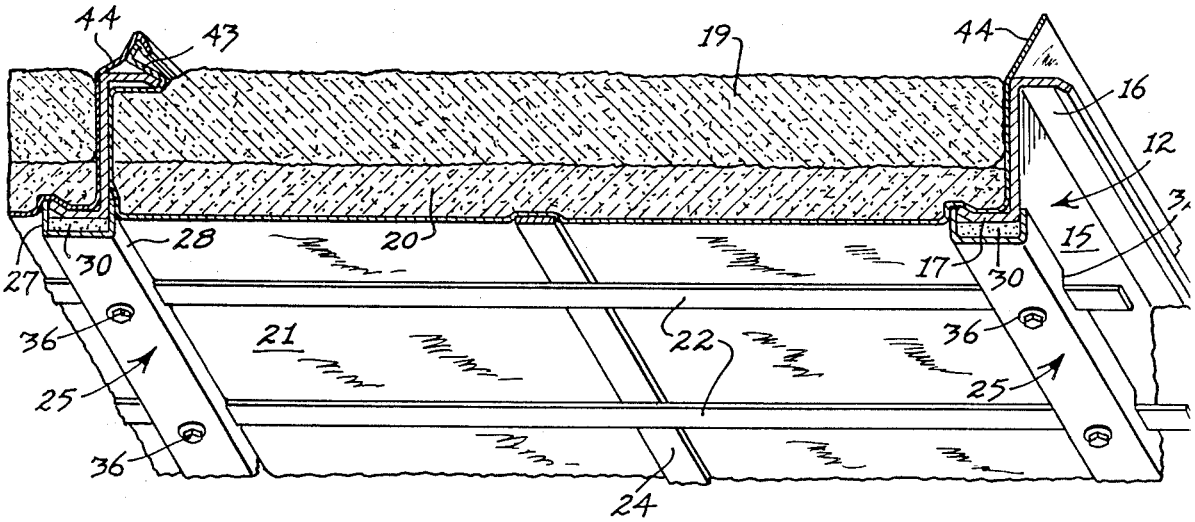
FIG. 5 is an enlarged, fragmentary, bottom perspective and transverse sectional view of a portion of the assembled insulated roof structure.

As best disclosed in FIGS. 3–5, each Z-purlin 12 includes an elongated vertical web 15 terminating in its upper end in a transverse top flange 16 and at its lower end in an oppositely extending, transverse bottom flange 17, of conventional construction. As best disclosed in FIG. 5, an upper insulation layer 19 and a lower insulation layer 20 are installed in the space between adjacent pairs of purlins 12, hereinafter referred to as the purlin cavity. These strips 19 and 20 have a width substantially equal to or slightly less than the transverse distance between the webs 15 of the adjacent purlins 12. The insulation layers 19 and 20 come in sections or pads and are laid end-to-end to extend longitudinally between the adjacent purlins, so that all of the space between all of the purlins 12 is filled with insulation. As illustrated in FIGS. 3 and 5, the combined heights of the insulation layers 19 and 20 is substantially equal to the height of each purlin 12. In a preferred form of the invention, the lower insulation layer 20 is provided with a facing 21 which is impervious to moisture.

The lower insulation layer 20 is held in its position within each corresponding purlin cavity by a lattice-work of transverse support straps or cross straps 22 and longitudinal support straps 24.

In order to insulate the bottom flange 17 of each purlin 12 and to simultaneously hold the transverse support straps 22 in operative position, the transverse support bar 25 has been designed. Each transverse support bar 25 is preferably elongated and channel-shaped, and preferably made of metal coated on the outside with paint or a baked enamel of a desired color for improved appearance, but which might also be made of plastic. Each channel-shaped support bar 25 includes an elongated bottom wall 26 substantially the same width, or possibly slightly wider than, the transverse width of the bottom flange 17 of each purlin 12. Projecting upward from the opposite sides of the bottom wall 26 are a pair of upstanding, preferably vertical, side walls 27 and 28, preferably of equal height.

Received within each channel-shaped support bar 25 is an elongated insulation strip or board 30, preferably made of an extruded polystyrene foam. In a preferred form of the invention, the height of the insulation board 30 is less than the height of the containing side walls 27 and 28 of the support bar 25, as best disclosed in the drawings.

Formed in the side walls 27 and 28 of each support bar 25 are a plurality of transversely aligned, and longitudinally spaced, notches 32, each having a width substantially the same as, or slightly larger than, the width of each corresponding cross strap 22. In a preferred form of the invention, particularly when the channel-shaped support bar 25 is made of metal, the notches 32 are formed by striking out portions 33 in the upper portions of the corresponding side walls 27 and 28. Not only do the struck-out portions 33 define transversely aligned notches 32 for receiving each corresponding cross strap, but also define retainer lugs or flanges for holding the corresponding elongated insulation board 30 in its corresponding channel-shaped support bar 25, as best disclosed in FIG. 4. Moreover, the struck-out lugs or portions 33 provide a smoother surface against which the cross strap 22 may seat or slide upon. Because the upper surface of the struck-out portions 33 is a coated metal, it presents little resistance to the sliding movement of the corresponding straps 22 when such straps are being positioned for assembly of the support structure.

Also in a preferred form of the invention, vertical fastener holes 34 and 35 are pre-formed or pre-punched through the corresponding bottom wall 26 of the support bar 25 and the insulation board 30, respectively, substantially midway between the notches 32 for receiving a vertical threaded fastener, such as a Tek screw 36. The aligned fastener hole 37 through the corresponding cross strap 22 will be self-formed as the Tek fastener 36 is installed through the support bar 25, the insulation board 30, and strap 22. The Tek fastener or Tek screw 36 will continue to be forced upward until it also pre-forms it own hole 38 in the bottom flange 17 of the corresponding purlin 12, as illustrated in FIG. 3.

After the Tek screw 36 is driven through the corresponding bottom wall 26, insulation board 30, cross strap 22, and bottom flange 17, the insulated support bar 25 is fully assembled upon the bottom of its corresponding purlin 16, as well as retaining all of the cross or transverse straps 22 extending between the support bar 25 and the bottom flange 17 of each corresponding purlin 12.

Supported by the cross straps 22 and extending longitudinally and parallel between adjacent pairs of purlins 12 is a longitudinal strap 24.

Figure 2:
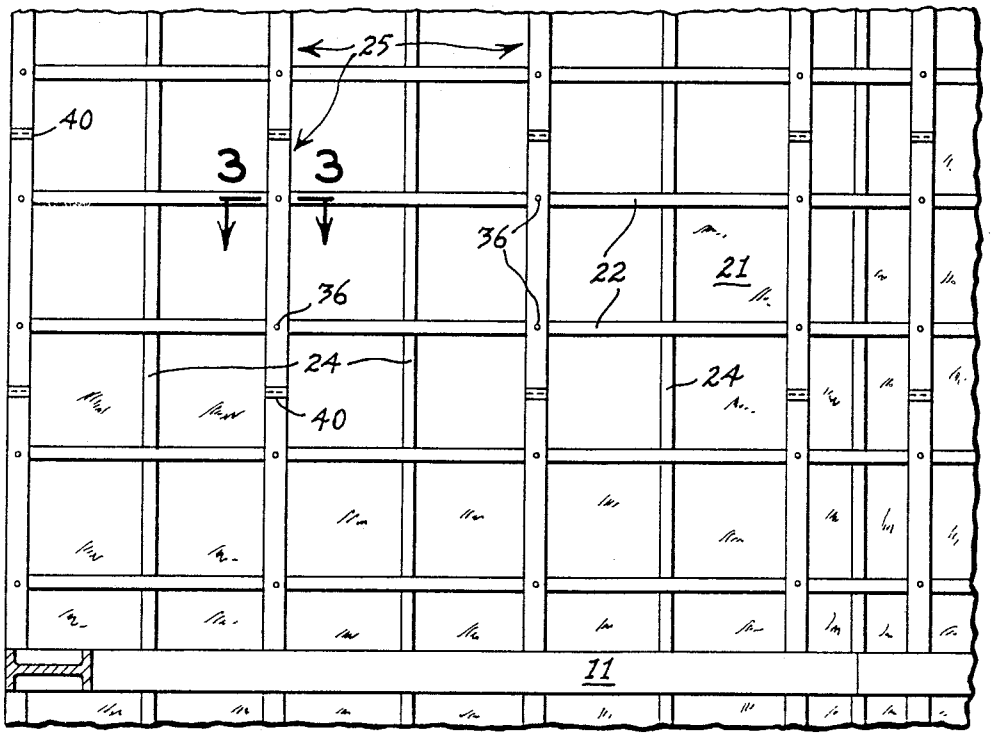
FIG. 2 is a fragmentary bottom plan view of the roof support structure, taken along the line 2—2 of FIG. 1.

After the cross straps 22 and longitudinal straps 24 are assembled perpendicular to each other in their lattice-work arrangement, as illustrated in FIGS. 2 and 5, the insulation layers 19 and 20 are then deposited in their corresponding purlin cavities upon the lattice-work of straps 22 and 24.

The operation of the invention commences essentially after the rafters 11 and the purlins 12 and eave struts 13 have been assembled in a conventional manner. Before the roof 14 and the insulation layers 19 and 20 are installed, a plurality of pre-cut strips of strap material used for forming the longitudinal straps 24 are first laid on the top surfaces of corresponding bottom purlin flanges 17, so that the longitudinal straps 24 will be readily available for subsequent positioning upon the transverse straps 22. Each of the transverse straps 22 and longitudinal straps 24 is preferably made of a semi-flexible metal strip having a bottom coated surface so that they will have an aesthetic appearance when viewed from beneath within the building 10.

Starting at the eave strut 13 in the first bay, that is the longitudinal distance between rafters, the first insulated support bar 25 including its insulation board 30 is placed against the bottom flange 117 of the eave strut 13 and clamped against the corresponding bottom flange 117 in its desired position co-extensive with the bottom of the eave strut 13. Care must be taken to position the clamps between the pre-formed fastener holes 34 and 35. A first strip of cross-banding material, from which the cross straps 22 are cut, is inserted through the first notches 32 in the clamped support bar 25, so that the cross strap material 22 will pass through the aligned notches 32 beneath the corresponding bottom flange 117. When the cross strap 22 is in its proper position between the bottom flange 117 and the support bar 25, an appropriate fastener, such as a Tek screw 36, is installed by an appropriate fastener tool upwardly through the pre-formed holes 34 and 35 and self-drills a hole 37 through the cross strap 22 and a hole 38 into the bottom flange 117 until the support bar 25 is secured against the bottom flange 117 of the eave strut 13.

Now that the support bar 25 has been secured against one strap 22 against the flange 117, the clamp may be removed and the second transverse strapping material inserted through the second transverse row of notches 32. After the transverse strapping material has been moved transversely of the support bar 25 to its desired position, the second Tek fastener 36 is installed through the support bar 25, the insulation board 30, the second strap 22 and the same bottom flange 117 of the same eave strut 13. As disclosed in the drawings, it has been found necessary to include only two sets of notches 33, and therefore two transverse straps 22 upon each eave strut 13 and purlin 12.

The operator or the roof installer than takes a second support bar 25, catches the loose portions of the straps 22 installed on the eave strut 13 and moves the support bar with the caught straps up toward the bottom of the first purlin 12. After the second support bar 25 is firmly seated against the bottom flange 17, the two straps 22 are pulled taut through the notches 32 of the second support bar 25 and the fasteners 35 installed in the flange of the first purlin 12, in the same manner as the fasteners were installed into the flange 117 of the eave strut 13.

The installer then takes a third support bar 25, catches the loose cross straps 22 and firmly clamps them against the bottom flange 17 of the second purlin 12. The third support bar 25 is then secured to the bottom flange 17 of the second purlin 12 with fasteners 36 to clamp the cross straps 22.

This procedure continues across the building until the transverse straps 22 are installed with the last support bar that course against the opposite eave strut 13. This operation is then repeated for the next course, each course depending upon the length of the support bars 25, which are preferably about 5'. The subsequent support bars 25 are attached for subsequent courses until the entire bay is filled. When the second course is started, each support bar 25 is placed in end-to-end abutting relationship with the installed aligned first support bar 25. The abutting ends may be sealed with insulating tap 40 (FIG. 2), if desired.

Figure 6:
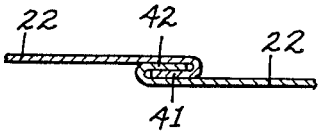
FIG. 6 is an enlarged fragmentary sectional view of an optional splicing structure for adjacent ends of a pair of support straps.

Although it is preferable to use a band of cross strapping material 22 which will extend the entire width of the building, of course this is not necessary, and shorter strips may be used by splicing the ends together, in a manner illustrated in FIG. 6. The inter-engaging hooked ends 41 and 42 of the opposed cross straps 22 may be taped together, if desired.

After all of the support bars 25 and cross straps 22 have been installed in all bays, that is in the space between all the rafters 11, the longitudinal support straps 24 may be laid on top of the cross straps 22 in a position substantially midway between adjacent purlins 12, so that the longitudinal straps 24 will extend the entire length of the building, and there will be at least one central longitudinal strap 24 between each pair of purlins 12.

After the lattice-work of straps 22 and 24 has been completed, the lower insulation layers 20 are placed with their facing 21 downward against the strap lattice-work between each pair of purlins 12. As the lower layers 20 are installed, the upper layers 19 are installed on top of the lower layers 20 to completely fill the purlin cavities.

Each of the sides of the lower layers 20 are preferably provided with upward projecting, flexible tabs 43 and 44. These adjacent tabs 43 and 44 are preferably folded over each other across the top flanges 16 of each purlin 12, as illustrated in FIG. 5, and secured by staples 45 (FIG. 3) or by tape, not shown.

Different combinations of insulation layers of different thicknesses can be used to fill the purlin cavity. Also, insulation can be installed in three layers with the top layer extending transversely over the purlins, to provide additional insulation between the purlin and the roof panel.

Then the entire installation process will be continued for each successive bay in the building until the entire roof structure has been insulated. Then, the metal roofing 14 may be installed over the top flanges 16 of the purlins 12 to completely encase the upper insulation layers 19.

After the operation is completed, the ceiling will include a solid layer of insulation. Not only will the spaces between the purlins 12 and eave struts 13 be insulated, but also the bottom of every purlin 12 and eave strut 13 will also be insulated to bridge the gaps between the insulation layers 20.

It will be seen from the above description of the assembly and operation of the installation of the straps 22 and 24 and the support bars 25, made in accordance with this invention, the insulation can be completed in a minimum of time with a minimum of effort, materials, and expense. The only materials needed for the installation of the insulation system, besides the two layers of insulation 19 and 20, are a sufficient number of insulated support bars 25 to cover the bottom flanges 17 of all of the purlins, and the transverse flexible straps 22 and longitudinal straps 24. Because of the minimum of installation time and materials, the expense of installing such an insulation roofing system is substantially less than other known methods of installing insulation roof support systems for metal buildings incorporating metal sheet roof, transverse rafters, and longitudinal purlins 12.

What is claimed is:

1. In an insulated roof support structure having a plurality of elongated, parallel, transversely spaced purlins, each purlin having a vertical web and an elongated horizontal bottom flange, and insulation layer material occupying the spaces between said webs, an insulation support system comprising:

(a) an elongated channel-shaped support bar including a bottom wall having a width substantially equal to the width of the bottom flange of each purlin, and a pair of opposed upward projecting side walls, (b) an elongated insulation strip of a width substantially equal to the width of said bottom flange of each purlin received coextensively within said channel-shaped support bar, (c) a plurality of transverse support straps, each transverse support strap extending transversely beneath said purlin bottom flange and above said insulation strip, (d) fastener means securing said support bar, said insulation strip, said transverse strap and said bottom flange together, so that said support bar extends co-extensively with said bottom flange, and said support bar and said insulation strip clamp and hold said transverse support strap against the bottom surface of said bottom flange, (e) a plurality of longitudinal support straps, each said longitudinal support strap extending longitudinally substantially midway between a pair of adjacent purlins, and (f) said longitudinal support straps and said transverse support straps supporting said insulation layer material between said purlins.

2. The invention according to claim 1 further comprising a pair of transversely aligned notches of uniform width formed in said opposed side walls of each said support bar, each said transverse support strap extending through said aligned notches beneath said purlin bottom flange and above said insulation strip.

3. The invention according to claim 2 in which the height of said insulation strip is less than the height of said side walls whereby said side walls project above opposite sides of said purlin bottom flange.

4. The invention according to claim 3 in which said aligned notches are defined by opposed struck-out portions of said opposed side walls, said struck-out portions projecting inward toward each other and over the top surface of said insulation strip to retain said insulation strip within said channel-shaped support bar, each said transverse strap extending through said aligned notches and over said struckout portions.

5. The invention according to claim 1 in which said fastener means comprises a single elongated fastener member penetrating said bottom wall, said insulation strip, said transverse strap, and said bottom flange.

6. The invention according to claim 1 further comprising said insulation layer material occupying the spaces between said webs consisting of a lower insulation layer having a bottom surface extending transversely substantially the distance between a pair of opposed webs of a pair of purlins, said lower insulation layer having a pair of transversely spaced flexible tabs on opposite sides of each purlin projecting upward to a height greater than the height of each said purlin, said insulation layer material further comprising an upper insulation layer extending over said lower insulation layer to a height substantially level with the upper portion of said purlins, said bottom surface resting on said transverse and longitudinal support straps, and means securing said tabs on opposite sides of a common purlin above said purlin.

* * * * *